United States Patent [19]

Mertz et al.

[11] Patent Number: 4,768,007

[45] Date of Patent: Aug. 30, 1988

[54] CURRENT BREAKING DEVICE WITH SOLID-STATE SWITCH AND BUILT-IN PROTECTIVE CIRCUIT BREAKER

[75] Inventors: Jean-Luc Mertz; Michel Lazareth, both of Grenoble; Hubert Guerin, Meylan, all of France

[73] Assignee: Merlin Gerin, Grenoble Cedex, France

[21] Appl. No.: 19,140

[22] Filed: Feb. 25, 1987

[30] Foreign Application Priority Data

Feb. 28, 1986 [FR] France ..... 86 02967
Feb. 28, 1986 [FR] France ..... 86 02968

[51] Int. Cl.[4] ..... H01H 9/02; H01H 13/04

[52] U.S. Cl. ..... 335/202; 361/8; 361/115

[58] Field of Search ..... 335/6, 14, 20, 202; 361/115, 189, 190, 8

[56] References Cited

U.S. PATENT DOCUMENTS 3,789,268 1/1974 Klein ..... 361/115
4,531,172 7/1985 Mertz ..... 361/13
4,626,951 12/1986 Nagao ..... 361/3

FOREIGN PATENT DOCUMENTS 0008989 3/1980 European Pat. Off. .
1104981 4/1984 European Pat. Off. .
2075290 4/1980 United Kingdom .

*Primary Examiner*—E. A. Goldberg
*Assistant Examiner*—Lincoln Donovan
*Attorney, Agent, or Firm*—Parkhurst & Oliff

[57] ABSTRACT

The device comprises a solid-state switch and a pair of mechanical contacts electrically connected in series. The solid-state switch is housed in a compartment towards the rear of the moulded case of the device, in thermal contact with an external metal plate. The solid-state switch housing is separated by an insulating partition from the remaining part of the moulded case, which contains the contacts, their operating mechanism, the arc chute and the trip unit. The power terminals and control terminals of the solid-state switch are located on the small side faces of the case on either side of the movement plane of the movable contact, which extends parallel to these small side faces.

6 Claims, 2 Drawing Sheets

CURRENT BREAKING DEVICE WITH SOLID-STATE SWITCH AND BUILT-IN PROTECTIVE CIRCUIT BREAKER

BACKGROUND OF THE INVENTION

The invention relates to a low voltage current breaking device with a modular case having a front face, two large parallel side faces, and two small side faces, each presenting a shoulder to house a pair of power terminals and a pair of control terminals, said shoulders being located opposite the front face towards the rear part of the case, in which case there are housed and connected in series a solid-state switch and a pair of separable contacts actuated by a mechanism having an operating toggle, located on said front face and a trip release causing the contacts to separate when a fault occurs thus protecting the solid-state switch.

A device of the kind mentioned, for example as described in U.S. Pat. No. 4,531,172, enables opening and closing of a circuit to be controlled by a solid-state switch, which may be remote controlled. When a fault occurs, the separable contacts open automatically protecting the solid-state switch and interrupting the circuit. Control of the separable contacts may be manual by means of a toggle located on the front of the device. The solid-state switch is housed inside the moulded case in a special compartment under one of the terminals, but this arrangement may cause overheating jeopardizing satisfactory operation of the device and in addition requires the profile of the case to be increased.

The object of the present invention is to achieve a device with a solid-state switch and built-in circuit breaker providing efficient cooling of the solid-state switch while complying with a standard size.

SUMMARY OF THE INVENTION

The device according to the invention in characterized by the fact that said case presents in its rear part a first housing confined by an external metal plate forming the back of the case and an intermediate separating partition of a second housing, and that the solid-state switch is located in said first housing in thermal contact with the metal plate, said separable contacts being housed in the second housing.

Cooling can be increased by adjoining a heat sink to the external metal plate and protection of the solid-state switch can be achieved by providing a shunting circuit of the solid-state switch which is switched into circuit by transferring the arc drawn between the contacts onto an arcing horn.

The shunting circuit advantageously comprises an arcing horn located in proximity to one of the contacts to pick up the arc as soon as the latter forms and this arcing horn extends in the direction of the other contact to constitute a preferential flashover area. When a flashover occurs, it does so on the arcing horn and not on the contact, thus preventing any current from flowing in the solid-state switch.

The power terminals and control terminals of the solid-state switch are located on the small side faces of the case, whereas the movable contact moves in a parallel plane to these small side faces. To limit the size of the case in the direction of the small side faces, the thermal trip release, notably the bimetal strip, is moved in an adjacent plane.

BRIEF DESCRIPTION OF THE DRAWINGS

Other advantages and characteristics will become more clearly apparent from the following description of an embodiment of the invention, given as an example only, and represented in the accompanying drawings, in which.

DESCRIPTION OF THE PREFERRED EMBODIMENT

Figure 1:
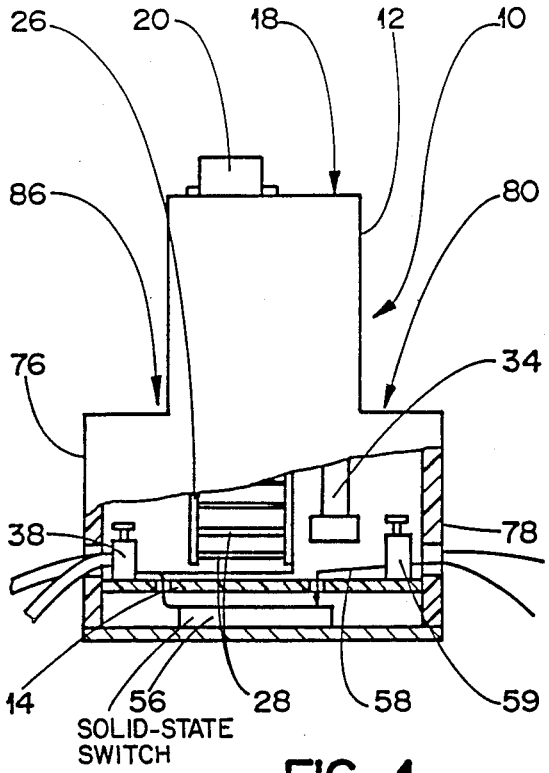
FIG. 1 is a partially cut-away schematic elevational view of the device according to the invention.

In the figures, a pole 10 of the modular switchgear device with a moulded case 12 has a front face 18 through which an operating toggle 20 passes. The rear face of the case 12 is constituted by a metal plate 16, which confines with an intermediate insulating partition 14 parallel to the plate 16, a housing 68 of small depth. In the remaining part of the moulded case 12 there are housed a pair of contacts 22, 24, an arc chute 26 with deionization plates 28 of the arc drawn between the contacts 22, 24, and an operating mechanism 30 actuated by the toggle 20 and by a trip unit 32. The trip unit 32 comprises a bimetal strip 34 and a coil 36 connected in series with the contacts 22, 24 between power terminals 38, 40 of the pole. The arc chute 26 is surrounded by two horns, the lower 39 and the upper 41, extending parallel to the plates 28 and to the partition 14. The mechanism 30 comprises a contact arm 42 bearing the movable contact 24 and pivotally mounted on a hinged lever 44 coupled by a bracket 46 to the toggle 20. A trip lever 48 is pivotally mounted on a spindle 50 and operates in conjunction with the end of the contact arm 42 to securedly unite the latter with the hinged lever 44. A latch 52 operates in conjunction with the trip lever 48, this latch being able to be actuated by the bimetal strip 34 in the vent of an overload or by the electromagnetic trip element 36. Releasing the latch 52 causes the trip lever 48 to pivot and the movable contact 24 to open due to the action of a spring (not shown). A solid-state switch 56, such as a triac or a pair of reverse-parallel connected thyristors, is electrically connected in series with the contacts 22, 24 and the trip elements 34, 36. The control circuit of the solid-state switch 56 is connected by conductors 58 to control terminals 59, 60. The solid-state switch 56 is electrically connected in the main circuit between the stationary contact 22 and the terminal 40. The movable contact 24 is connected to the opposite terminal 38 via the coil 36 and the bimetal strip 34. The current entering at a given moment via the terminal 38 flows through the bimetal strip 34, the coil 36, the contacts 22, 24, and the switch 56, and exits via the terminal 40. The upper arcing horn 41 is connected to the terminal 38, whereas the lower arcing horn 39 extends up to the proximity of the stationary contact 22 being separated from the latter by a small clearance 66. The lower arcing horn 39 is in addition connected by a conductor 62 to a connection point 64 of the main circuit located between the solid-state switch 56 and the terminal 40.

A current breaking device of this kind is described in detail in the above-mentioned U.S. Pat. No. 4,531,172, which should be advantageously referred to in order to understand the operation. It is sufficient here to recall that the solid-state switch 56 allows remote control of opening and closing of the device in normal operation. If a fault occurs, the bimetal strip 34 or the coil 36 causes automatic opening of the contacts 22, 24 and high-speed switching of the arc onto the horn 39, switching in the shunting circuit 39, 62, of the solid-state switch 56, which is thus efficiently protected against overload and short-circuit currents which might destroy it.

Figure 3:
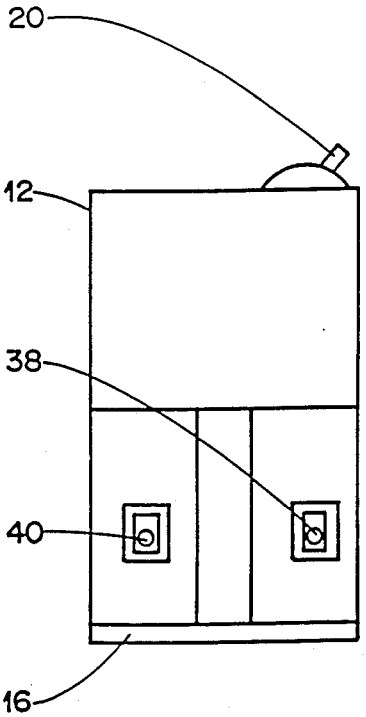
FIG. 3 is a left-hand side view of the device according to FIG. 1.
Figure 2:
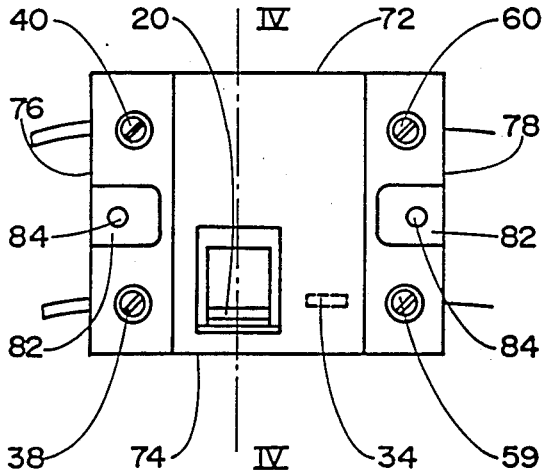
FIG. 2 is a plan view of FIG. 1.
Figure 4:
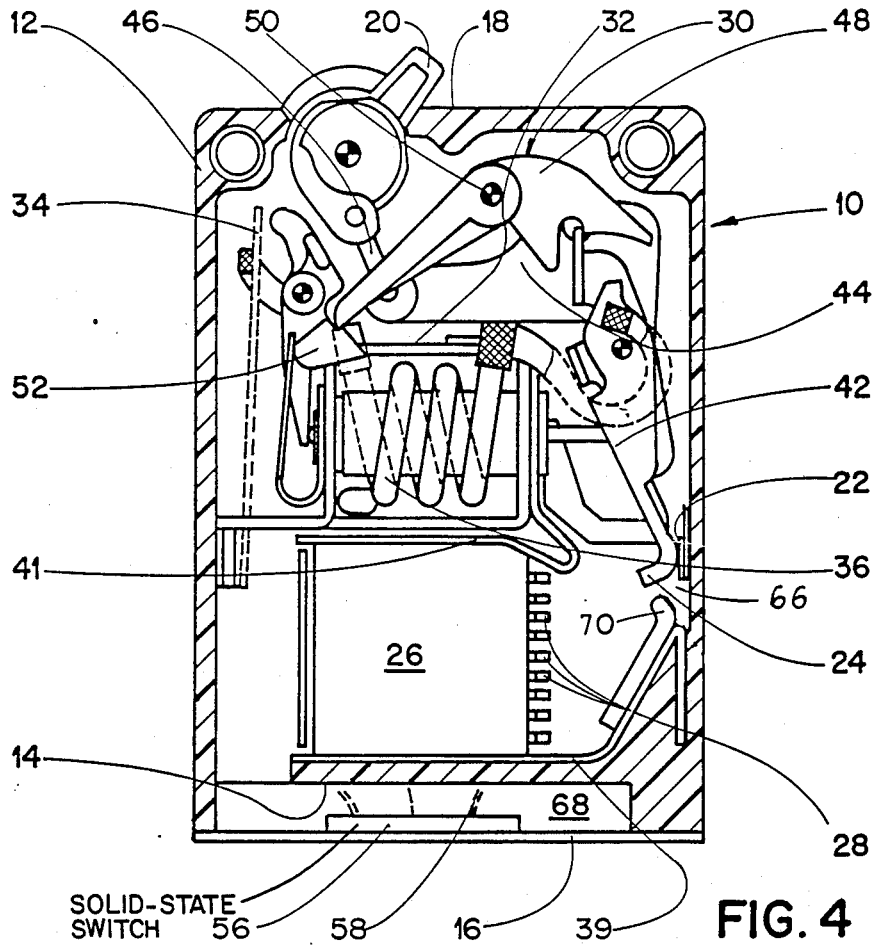
FIG. 4 is a cross-section according to the line IV—IV of FIG. 2, on an enlarged scale.
Figure 5:
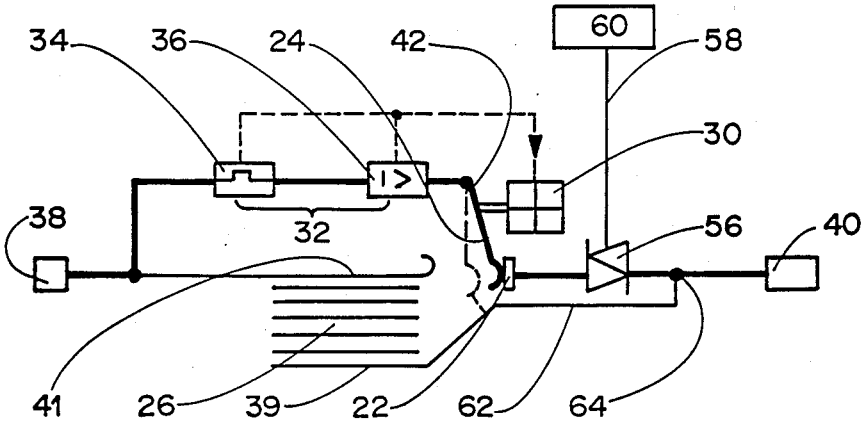
FIG. 5 shows the wiring diagram of the device according to FIG. 1.

Referring more particularly to FIGS. 1 to 3, it can be seen that the case 12 comprises two large parallel side fences 72, 74 and two small parallel side faces 76, 78 having shoulders 80 bounding an enlarged part towards the rear of the case 12. The power terminals 38, 40 are located near the small side wall 76 in the enlarged part 80 of the case, whereas the control terminals 59, 60 are located on the opposite side towards the small side wall 78. The arc chute 26, coil 36 and mechanism 30 are superposed parallel to the small side faces 76, 78 being fitted between the intermediate partition 14 and the toggle 20. The bimetal strip 34 is laterally offset in relation to this stacking to reduce the size of the case 12 in the direction of the small side faces 76, 78. In FIG. 4, the bimetal strip 34 has been represented in the plane in an unbroken line to make the operation easier to understand. The movement plane of the movable contact 22 is parallel to the small side faces 76, 78. The enlarged part 80 of the case 12 presents notches 82 freeing the central part of the metal plate 16 adjacent to the edges of the walls 76, 78. These freed parts of the metal plate 16 have holes 84 for fixing screws, notably to a heat sink (not shown) adjoining the metal plate 16.

Locating the power terminals 38, 40 and the control terminals 59, 60 on the small side faces 76, 78 and fitting the bimetal strip 34 and the stacking comprising the arc chute 26, coil 36 and mechanism 30 between these terminals, enables a compact arrangement to be achieved respecting the conventional dimensions of such devices. The toggle 20 located on the front allows manual control of opening and closing of the device. The particular shape of the case 12 enables a series of devices to be aligned, the large side faces 72, 74 of the successive devices being placed adjoining one another. The solid-state switch 56 is located in a separate housing accessible from the outside.

In the preferred embodiment represented in the figures, shunting of the solid-state switch 56 is performed by transferring the arc onto the arc guiding horn 39, 70 located in proximity to one 22 of said contacts and shaped in such a way that as soon as the contacts separate, the distance between the horn 70 and the other of the said contacts 24 is smaller than the distance separating the contacts 22, 24 to avoid any arc flashover on the contacts.

As shown in FIG. 4, the end of the arcing horn 39, separated from the stationary contact 22 by a small clearance 66, presents a hump 70 in the direction of the movable contact 24. With respect to the plane passing through the contact point of the pair of contacts 22, 24 and perpendicular to the direction of movement of the movable contact 24, the hump 70 is laterally offset from the stationary contact 22 in the opening direction of the movable contact 24. The hump 70 is thus located before the stationary contact 22 with respect to the closing direction of the movable contact at a smaller distance from this contact than the distance separating the contacts 22, 24, in the course of opening or in the open position. In the case of a flashover, the latter will occur between the movable contact 24 and the hump 70 and not between the contacts 22, 24. In this way switching the solid-state switch 56 back into circuit with risks of damage is avoided.

We claim:

1. A low voltage current breaking device with a modular case having a front face, two large parallel side faces, and two small side faces, each presenting a shoulder to house a pair of power terminals and at least one control terminal, said shoulders being located opposite the front face towards the rear part of the case, within said case being housed and connected in series a solid-state switch and a pair of separble contacts actuated by a mechanism having an operating toggle, located on said front face, and a trip unit causing the contacts to separate when a fault occurs thus protecting the solid-state switch, said case including in its rear part a first housing confined by an external metal plate forming the base of the case and an intermediate separating partition of a second housing, only the solid-state switch being located in said first housing in thermal contact with the metal plate, said separable contacts, mechanism and trip unit being located in the second housing, whereby said first housing is thermally isolated from said second housing;

said breaking device further comprising a shunting circuit of the solid state switch including an arc guiding horn located in proximity to one of said pair of contacts, said horn being shaped so that as soon as the contacts separate, the distance between the horn and the other of said pair of contacts is smaller than the distance separating the pair of contacts, whereby an arc drawn when the pair of contacts separate is transferred to said shunting circuit avoiding flashover between said pair of contacts and protecting the solid state switch from a fault current.

2. A breaking device according to claim 1, wherein a movement plane of one of said pair of contacts is parallel to said small side faces.

3. A breaking device according to claim 1, further comprising an arc chute located in said second housing, adjacent to the intermediate partition, a first end plate of said arc chute being included in said shunting circuit of the solid-state switch.

4. A breaking device according to claim 3, wherein the trip unit comprises a magnetic trip element and a thermal trip element, the magnetic trip element and the mechanism being superposed between the arc chute and the front face of the case parallel to the small side faces of the case to form a stack, the thermal trip element being located in a plane adjacent to said stack.

5. A breaking device according to claim 1, wherein the pair of power terminals are located on one of the small side faces of the case, the control terminals being located on an opposite small side face.

6. A breaking device according to claim 1, wherein said metal plate includes, on edges adjacent to the small side faces, holes for screws to fix a heat sink adjoining an external face of the plate, said shoulders having notches facing said holes.

* * * * *